US007658162B2

(12) United States Patent
Kreshek

(10) Patent No.: US 7,658,162 B2
(45) Date of Patent: Feb. 9, 2010

(54) SELF ADHESIVE MEDICATION REMINDER DEVICE

(75) Inventor: Jeffrey H. Kreshek, Encino, CA (US)

(73) Assignee: Ace Venture, Inc., Encino, CA (US)

( * ) Notice: Subject to any disclaimer, the term of this patent is extended or adjusted under 35 U.S.C. 154(b) by 0 days.

(21) Appl. No.: 12/196,645

(22) Filed: Aug. 22, 2008

(65) Prior Publication Data

US 2009/0178609 A1 Jul. 16, 2009

Related U.S. Application Data

(60) Provisional application No. 61/021,116, filed on Jan. 15, 2008.

(51) Int. Cl.
*G09F 9/00* (2006.01)

(52) U.S. Cl. ..... 116/311; 116/308; 206/534

(58) Field of Classification Search ..... 116/311, 116/306, 308, 309, 312, DIG. 3; 40/310, 40/311, 113–115; 206/534
See application file for complete search history.

(56) References Cited

U.S. PATENT DOCUMENTS

| | | | | | |
|---|---|---|---|---|---|
| 623,171 | A | * | 4/1899 | Mowry | 116/308 |
| 1,211,737 | A | * | 1/1917 | Martini | 116/308 |
| 1,796,398 | A | * | 3/1931 | Richardson | 116/308 |
| 2,024,889 | A | * | 12/1935 | Simeone | 116/311 |
| 2,066,183 | A | * | 12/1936 | McHaffey | 116/308 |
| 2,450,949 | A | * | 10/1948 | Gattuccio et al. | 116/308 |
| 2,565,095 | A | * | 8/1951 | Schatzkin | 116/308 |
| 2,587,147 | A | * | 2/1952 | Guion et al. | 116/308 |
| 2,713,845 | A | * | 7/1955 | Silverman | 116/308 |
| 2,817,451 | A | * | 12/1957 | Giles et al. | 215/230 |
| 3,032,003 | A | * | 5/1962 | Lambert et al. | 116/311 |
| 3,437,236 | A | * | 4/1969 | Huck | 206/534 |
| 3,446,179 | A | * | 5/1969 | Bender | 116/308 |
| 3,675,620 | A | * | 7/1972 | Baustin | 116/308 |
| 3,921,568 | A | * | 11/1975 | Fish | 116/308 |
| 4,148,273 | A | * | 4/1979 | Hollingsworth et al. | 116/325 |
| 4,345,541 | A | | 8/1982 | Villa-Real | |
| 4,347,804 | A | * | 9/1982 | Villa-Real | 116/308 |
| 4,405,045 | A | | 9/1983 | Villa-Real | |
| 4,666,051 | A | * | 5/1987 | Trick | 215/230 |
| 4,729,472 | A | * | 3/1988 | Lubin et al. | 206/315.9 |
| 4,985,879 | A | * | 1/1991 | Owens | 368/89 |
| 5,152,422 | A | | 10/1992 | Springer | |

(Continued)

*Primary Examiner*—R. A. Smith
*Assistant Examiner*—Tania C Courson
(74) *Attorney, Agent, or Firm*—Berenato & White, LLC

(57) ABSTRACT

The present invention is a dosage reminder device that serves as a regular and constant reminder of when a medication was last taken as well as when a medicine should next be taken. The device is attached to any medicine box or bottle using a self-adhesive backing element and, owing to its relative simplicity and low cost, can be disposed of once the medication has been used or is no longer needed. The self-adhesive backed dial portion includes an opposed raised annular rim with radially inwardly oriented detents. The center of the dial includes a receptacle in the center for receiving a pin for pinning in-place a multi-pointed indicator whose pointer end elements engage securely in the radially inwardly directed detents. By being mechanically engaged in 2 locations, the dial indicator resists movement, even with inadvertent patient dropping or scraping of the medication receptacle, thusly clearly and securely showing dosage timing.

8 Claims, 2 Drawing Sheets

U.S. PATENT DOCUMENTS 5,267,526 A * 12/1993 Totsuka ..... 116/291
5,279,422 A * 1/1994 Adams ..... 206/534
5,313,439 A 5/1994 Albeck
5,358,117 A * 10/1994 Adams ..... 206/534
5,377,614 A 1/1995 Glazer
5,482,163 A * 1/1996 Hoffman ..... 206/534
6,152,067 A 11/2000 Mathison
D461,139 S 8/2002 Hawley
6,561,124 B1 * 5/2003 Marczynski et al. ..... 116/309
7,017,513 B2 3/2006 Giewercer
7,032,535 B2 * 4/2006 Halstead et al. ..... 116/308
7,100,530 B2 * 9/2006 Lu ..... 116/307
7,263,947 B2 9/2007 Giewercer
7,314,022 B2 * 1/2008 Sollaccio ..... 116/308
2004/0173137 A1 * 9/2004 Carbajal ..... 116/311
2005/0056203 A1 3/2005 Giewercer
2006/0180566 A1 8/2006 Mataya
2008/0000799 A1 * 1/2008 Arvidsson et al. ..... 206/534
2008/0308033 A1 12/2008 Cirrincione

* cited by examiner

SELF ADHESIVE MEDICATION REMINDER DEVICE

This application claims the benefit of U.S. provisional Application No. 61/021,116, filed Jan. 15, 2008.

BACKGROUND OF THE INVENTION

1. Field of the Invention

The invention relates generally to a self adhesive medication reminder device. More specifically, the invention relates to a self-adhesive medication reminder device using a time indicator dial re-settable by the user.

2. Background

Millions of people annually take medications for a specific, short term illness, or over the counter medications for a specific ailment. In recent years, the incident of overdose has dramatically risen leaving the medical profession liable for damages as a result of such overdoses. With the medications needed at specific intervals, the need for a reminder of when a dosage was taken or next needs to be taken is critical. Other known devices such as U.S. PG Pub. No. 2006/0180566A1 and U.S. Pat. No. 4,405,045 are one dimensional in their approach with the only application being in conjunction with a vial provided by the pharmacy or other medical professional. Such known devices are typically bulky and overly complicated with a variety of date, day and time functions. The device(s) is more or less designed to be useful in the long term administration of medicine, as opposed to short term doses, and is not particularly adaptable to medications that come in boxes, tubes or oddly shaped bottles. Furthermore, these devices rely heavily on the long term calibration between the device and the prescription frequency on the label of the bottle itself. Other known devices attempt to provide the user with a similar result but require the wholesale transfer of the medication from the original container to a new reminder device.

U.S. Pat. No. 5,152,422 and U.S. Pat. No. 5,313,439 accomplish the goal of reminding the patient of the next interval for taking the prescribed medication while sacrificing valuable prescription medication information that is typically presented on the original bottle from the pharmacist. The prescription information or directions contained on the bottle or box is important to the patient to confirm or remind the patient of the proper interval. Should a patient transfer its medication to such a device, then dispose of the original container, and then potentially forget or miss-calibrate the device, the patient could be susceptible to an overdose. In addition, such devices potentially introduce the problem of not being able to later identify the medication as it is no longer clearly identified on the label. Thus, such devices are only valuable to long term patients or chronic patients who consistently take the same medication, at the same intervals over long periods of time. Such devices do not serve the non-chronic or temporary patients well. Additionally, such devices are not readily adaptable to medications that come in boxes or tubes or are purchased over the counter.

Other known devices such as U.S. Pat. No. 4,345,541 attempt to yield the same results but have the (potentially) fatal flaw of rotation to the outer ring of the device thus making the device highly susceptible to unwanted or undesired movement. With the ease of change to the timing devices, a user can never be completely sure that the interval shown on the dials has not inadvertently been moved or adjusted. Similarly, U.S. Pat. No. 5,377,614 introduces the potential for error in use of the two dials. Should the dials be reset accidentally, the user would be left without a clear indication of when the last dose was administered and when the next dose should be administered.

Therefore, there is found a need for a reliable, inexpensive and disposable reminder device to aid in reminding patient of the intervals at which they are due to ingest specific dosages of medicine.

SUMMARY OF THE INVENTION

The present advantageously fills the aforementioned deficiencies by providing a secure self adhesive medication reminder device that results in a relatively fixed dial indicator system for indicating dosage timing. The invention is a self adhesive medication reminder device and is made up of the following required elements: a self adhesive backing 12, an advertising space 18, a main disk 14 with twenty four individual time grooves 14*a* representing the hours of a day 12*b*, a central pin 16 with the reminder hands attached 16*a* and 16*b*.

Optional feature(s) would be the dedicated advertising space identified as item 18 on the attached images. The device itself functions with or without the dedicated advertising space. The dedicated advertising space can be eliminated with absolutely no detrimental effect on the device itself.

Likewise the shape of the back element can be altered to any shaped configuration and, although shown in rectangular form, could be any shape that could accommodate the surface dial and central pin configuration.

Finally, it is an object of the present invention to provide a self adhesive medication reminder device that does not suffer from any of the problems or deficiencies associated with prior solutions.

The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
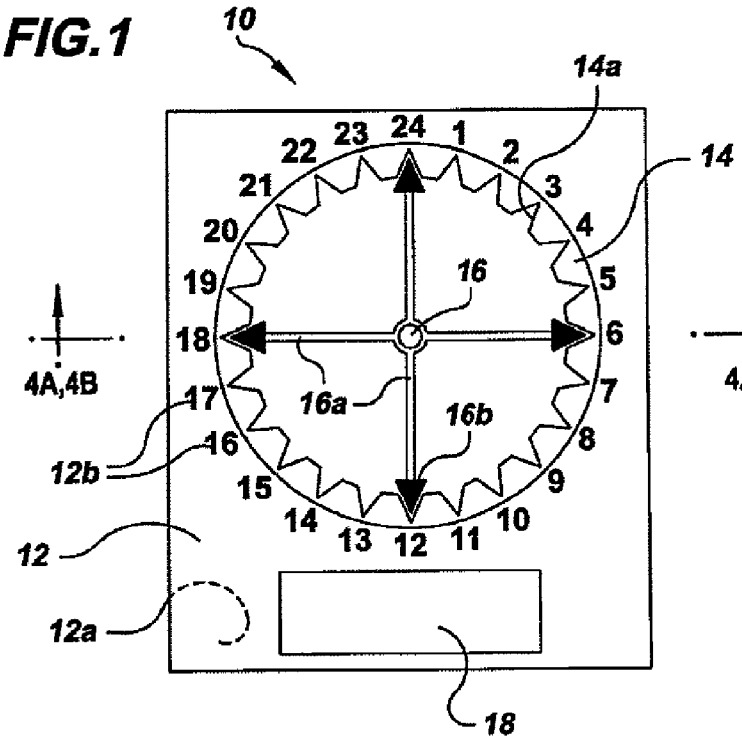
FIG. 1 is a top plan view of the invention 10.
Figure 2:
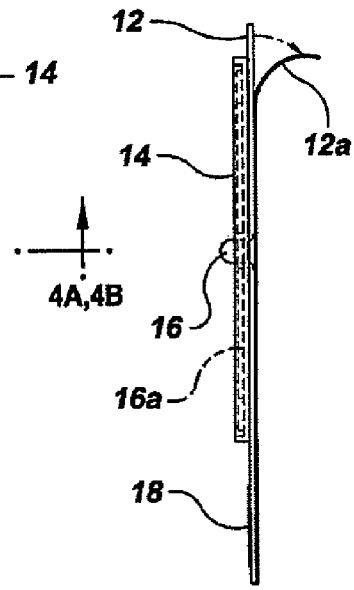
FIG. 2 is a side view of the invention 10.
Figure 3:
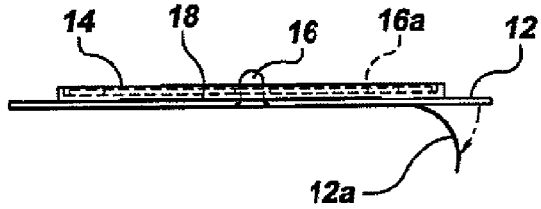
FIG. 3 is an end view of the invention 10.
Figure 4A:
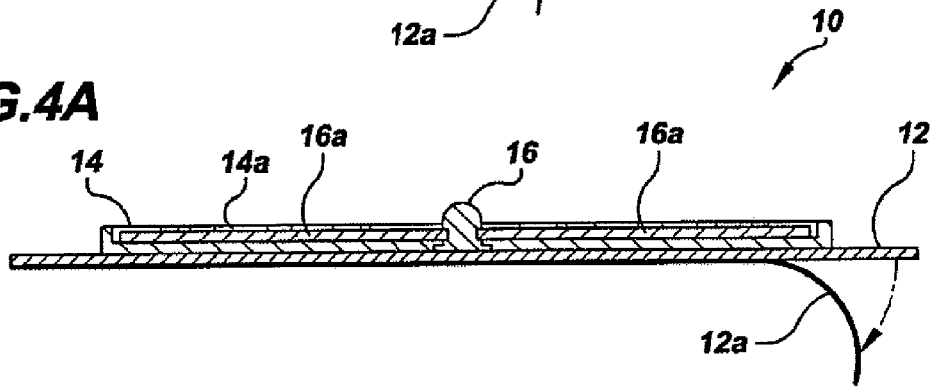
FIG. 4A is an enlarged cross section view of the invention shown in the set position and taken along lines 4A-4A of FIG. 1.
Figure 4B:
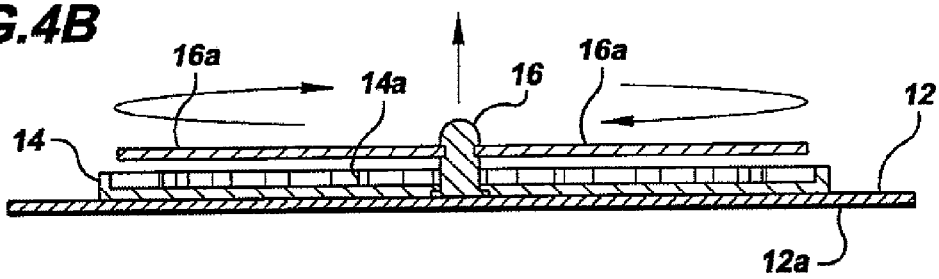
FIG. 4B is also an enlarged cross section view of the invention shown in the unset position and taken along lines 4B-4B of FIG. 1.
Figure 5:
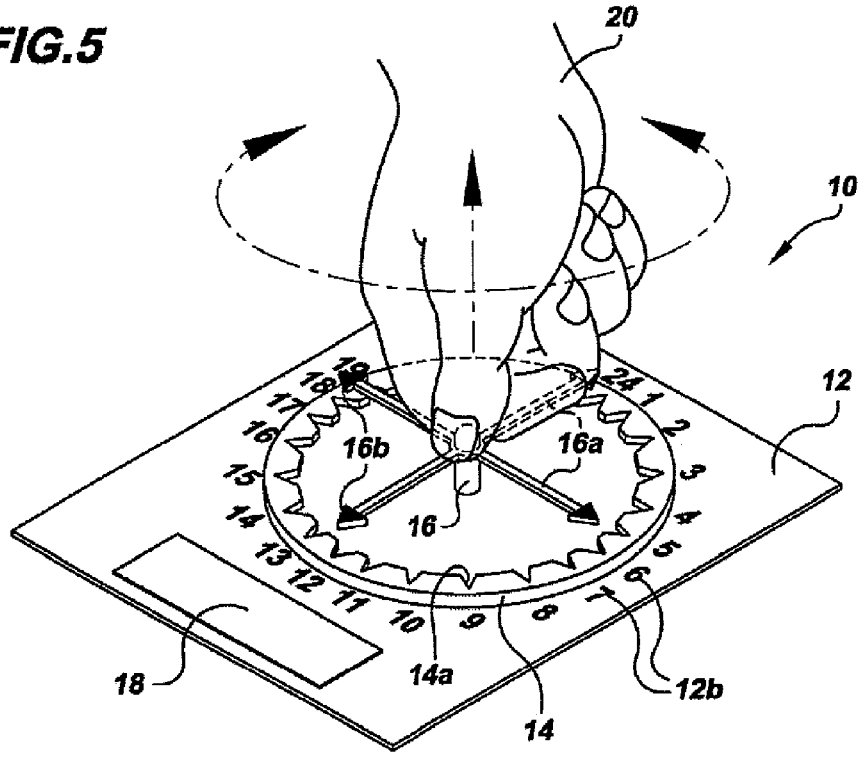
FIG. 5 is a perspective view of the invention 10 shown with the central pin 16 and reminder bands 16*a* raised away from the main disk 14 and time grooves 14*a* being adjusted to the proper position.
Figure 6:
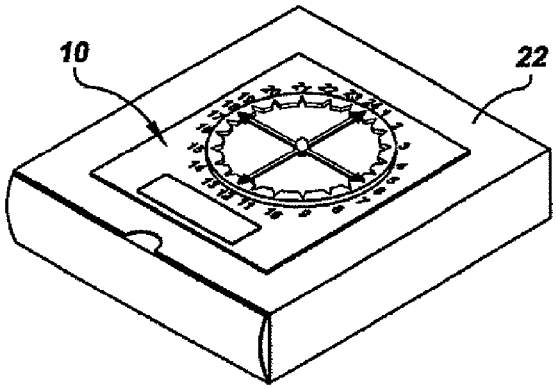
FIG. 6 is a perspective view of the invention 10 shown attached to a box 22 of medication.
Figure 7:
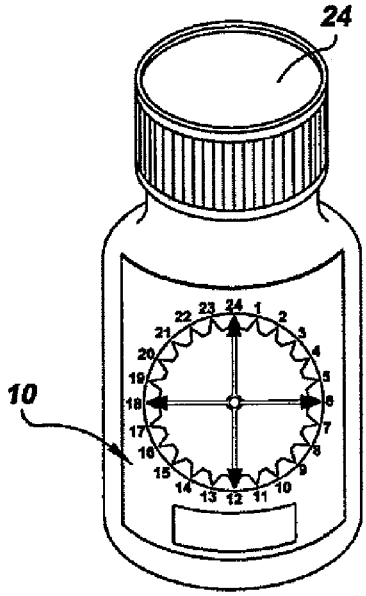
FIG. 7 is a perspective view of the invention 10 shown attached to a bottle 24 of medication.

With reference to the drawing FIGS. 1-7 et seq. The invention 10 provides the user with a simple way of keeping track of medication dosage times and also aids in remembering what time a specific dosage of medication was last taken. The device is not designed to actually administer a dosage or act as an electronic reminder. The invention 10 is designed to easily attach to a box 22 or bottle 24 of medication and specifically mark the hour of the dosage last administered and count out in set intervals of three, six, eight or twelve hours as to what time the next dosage should be administered. The self adhesive medication reminder device makes use of a self adhesive backing 12 of plastic, or paper, with plastic being the preferred material, with a plastic main disk 14 attached having twenty four individual grooves 14*a* which mark the twenty four hours of the day. The twenty-four individual grooves 14*a* are marked numerically with corresponding numbers printed 12*b* on the plastic or paper backing 12.

To use the device, the paper covering 12*a* on the back of the plastic backing 12 which protects the adhesive is removed and the device is placed on a box 22 or bottle 24 of medication. The device has a rubber central pin 16 in the middle of the main disk 14 which holds the reminder hands 16*a*. The reminder hands 16*a* have color coded arrow heads 16*b* which can be colored in one, two, three or four different colors and are used to clearly distinguish between the first dose and doses after. The color-coded arrow heads 16*b* of reminder arms 16*a* set within grooves 14*a* of main disk 14. The central pin 16 is pulled upward above the main disk 14 and turned to the desired hour and then lowered back down so color coded arrow heads 16*b* of reminder arms 16*a* set back within grooves/detents 14*a* of the main disk 14. The reminder hands 16*a* can have one, two, three, four, six or more arms depending on the medication dosage required.

The advertising space 18 is clearly marked on the self adhesive backing 12 using a material such as, but not limited to ink, paint or laser engraving. The adhesive backing can be produced using various materials such as, but not limited to, flexible or hard plastic, cloth or cardboard. One side of the self adhesive backing is covered with a commercial grade glue such as those found on band aids or stickers, and again covered with a peelable paper 12*a*, thus allowing the user to peel the paper off of the device and, using the glue side, attach the device to a box 22 or bottle 24. Flexible plastic is the preferred backing material. The main disk 14 can be produced using plastic or some other rigid material and the twenty-four hour individual time grooves 14*a* would be fashioned out of whatever material is used for the main disk. The central pin 16 can be made of various materials flexible enough to allow for easy movement of the reminder hands 16*a* and 16*b*. Materials such as rubber, string, or elastic are preferred. The key characteristic of this particular component is flexibility. The reminder dial can be produced out of materials such as plastic, wood, metal, or any other rigid material that will easily set into the twenty four hour grooves and withstand any external forces without easily breaking, bending to extremes, or moving. Shown here as a pin-wheel indicator with individual arms corresponding to hour intervals through a 24 hour period, the indicator 16 could also comprise a marked disc with detent/groove 14 engaging pointers 16*b* located thereon and extending therefrom radially outwardly.

While all components of the device could be manufactured using flexible plastic, wood, metal, hard plastic or cardboard, the preference is for all components to be manufactured using flexible plastic. The central pin 16 in particular should be made of a rubber band like material, with the key characteristic of elasticity and flexibility, making it easy for the pin to be pulled from the set position in order to move the reminder hands 16*a* to their proper position.

While the present invention has been described above in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A self adhesive medication timing reminder device, comprising:

a backing element including a first side and a second side, said first side including an adhesive layer for affixing the device to a substrate, said second side having a raised annular ring element affixed to and protruding there from, said annular ring including a centrally located receptacle and a selectively upward removable flexible pin element for engaging said receptacle and holding in position a pin-wheel indicator, said pin-wheel indicator including a central bore for accepting said flexible pin element inserted there through and further including radially outwardly directed plural indicator pointing elements, said radially outwardly directed indicator pointing elements engaging complementary inwardly directed grooves in said raised annular ring when said flexible pin is selectively re-inserted and engaged though said central bore into said centrally located receptacle and said pin-wheel indicator is thereby securely held in position.

2. A device as in claim 1, further wherein:

said backing element exceeds the size of said annular ring element so as to provide a printable space adjacent said annular ring.

3. A device as in claim 1, wherein:

said flexible pin is rubber.

4. A device as in claim 1, wherein:

said pin-wheel indicator is flexible plastic.

5. A device as in claim 1, wherein:

said inwardly directed grooves include 24 individual grooves to match hours in a day.

6. A device as in claim 1, wherein:

said pointing elements are color coded to indicate $1^{st}$ and b $2^{nd}$ and subsequent doses over a 24 hour time period.

7. A device as in claim 1, wherein:

said adhesive is concealed beneath a peelable backing and, when prepared for use, is peeled to expose said adhesive.

8. A device as in claim 1, wherein:

said pin-wheel is available in a plurality of predetermined configurations reflecting incremented dosage intervals of 2 hour, 3 hour, 4 hour, 6 hour, 8 hour, and 12 hour and a corresponding number of pointing elements.

* * * * *